United States Patent [19]

Preston

[11] 4,319,702

[45] Mar. 16, 1982

[54] POCKET CREASING APPARATUS AND METHOD OF CREASING WITH SAME

[75] Inventor: Harold Preston, Clifton, N.J.

[73] Assignee: Automated Components, Inc., Belleville, N.J.

[21] Appl. No.: 73,676

[22] Filed: Sep. 10, 1979

[51] Int. Cl.[3] ..... A41H 33/00

[52] U.S. Cl. ..... 223/38

[58] Field of Search ..... 223/37, 38, 52; 38/1 D; 2/243 B

[56] References Cited

U.S. PATENT DOCUMENTS 2,398,325 4/1946 Preston ..... 38/1 D 2,562,398 7/1951 Silverman ..... 223/38 X 4,124,424 11/1978 Preston ..... 223/38 X

*Primary Examiner*—Louis Rimrodt

*Attorney, Agent, or Firm*—James N. Blauvelt

[57] ABSTRACT

Improved apparatus and method for forming and maintaining a desired configuration in fabric pieces, such as a pocket during manufacture of a product comprising the fabric such as a garment, by the simultaneous application of heat and pressure (without the need of shaping overlays such as paper) to the fabric piece with such apparatus, which has an improved pressing means for maintaining the desired configuration in said fabric pieces while limiting the resultant movement of the heated, compressed product in response to the pressure to which it has been subjected.

12 Claims, 4 Drawing Figures

POCKET CREASING APPARATUS AND METHOD OF CREASING WITH SAME

BACKGROUND OF THE INVENTION

1. Field of the Invention

The present invention relates generally to the manufacture of products comprising fabric pieces and more particularly to an improved method and apparatus for forming and maintaining a desired configuration in a fabric piece such as a pocket during manufacture of a product comprising the fabric such as a garment.

2. Description of the Prior Art

Manufacture of products comprising fabric pieces usually requires that one or more fabric pieces of which the product is composed be formed and maintained in a particular configuration while the product is being manufactured. For example, in the manufacture of garments, it is often necessary to fold and/or crease separate fabric pieces such as blanks for pockets, facings, cuffs, yokes, etc., prior to securing the piece to the garment itself. Since the fabric pieces will ultimately be secured to the garment in their folded or creased configuration and thereafter so maintained by permanent securing means such as stitching or permanent-type adhesives, it is only necessary to maintain these pieces in their folded or creased configuration up to the time that they are permanently secured to the garment. It is known to temporarily configure these fabric pieces by the simultaneous application of steam and pressure and through the use of shaping overlays such as paper.

However, heretofore, use of such overlays has required separate processing steps to insert and remove the overlays. Typically, such overlays have constituted crude or unfinished paper forms such as newspaper, which has accordingly required that stocks or inventories of such paper, e.g., newspaper, of desired shape and size be prepared and kept on the processing premises for use as a source of such overlays.

This has led to the adoption of processes that use adhesives, in combination with pressure, such as shown in U.S. Pat. No. 4,124,424, in lieu of the more conventional steam or heat and pressure processes and apparatus. However, use of adhesives introduces matters of additional complexity, as well as increased costs of materials; for example, use of adhesives involves materials handling problems with dangerous and/or flammible chemicals which, when employed, usually result in emission of noxious odors and/or fumes which have to be removed by proper air conditioning or ventilation systems, operated in compliance with federal and/or state environmental statutes and regulations. Additionally, process operators and their employees or representatives do not usually like to work with chemicals. Hence, the present art with which this invention is concerned is still looking for a new means by which to return to the utilization of apparatus and methods for forming and maintaining a desired configuration in a fabric piece during manufacture of a garment comprising the fabric by simultaneous application of steam or heat, preferably heat, and pressure. The present invention is believed to fill this void in that it eliminates or otherwise avoids the problems associated with processes that use adhesives (by not using such adhesives) while, at the same time, obviating the difficulties and drawbacks associated with past steam-and-pressure processes. In addition, new and additional advantages are realized with practice of the present invention.

SUMMARY OF THE INVENTION

The present invention is embodied in and carried out by a method and apparatus for forming and maintaining a fabric piece in a desired configuration during manufacture of a product comprising the fabric piece. As used herein, the term "fabric" is intended to include woven and knitted fabrics. The method comprises inserting the fabric piece to be creased in desired configuration into the present apparatus and compressing the fabric piece, through application of heat and pressure, whereby the fabric piece is maintained in the formed, desired configuration during at least part of the manufacture of the product. The product may consist of only the fabric piece wherein it is desired to temporarily form and maintain folds or creases therein. The product is preferably a fabric product which is preferably a garment, and the fabric pieces preferably comprise pockets, facings, cuffs, yokes and the like. However, creases, facings, hems and the like in or on the fabric product itself may also be configured and maintained during manufacture. Additionally, the method is applicable to configure product accessories and to configure other products such as belts during manufacture thereof. The apparatus according to the invention comprises first die means disposed in a first plane, second die means disposed in a second plane parallel to the first plane, at least one of the first and second die means comprising die members disposed in a respective die means plane and opposed at least in part, the die members being operative to be moved along the respective plane, die moving means for moving at least one of the first and second die means through coincidence of the first and second planes between positions in which the first and second planes are spaced apart, die member moving means for moving the die members along the respective plane, novel pressure means for selectively applying pressure between the pressure means and at least one of the first and second die means, whereby relative movement of the die means through the coincidence thereof is operative to fold at least a part of a fabric piece initially positioned between the die means, movement of the die members along the respective plane is operative to fold the said at least part of the fabric piece on itself, and the novel pressure means is operative to selectively apply pressure on the said at least part of the fabric piece which is folded on itself. Heat may be applied to the selected parts of the fabric piece after it has been placed on the apparatus and before compression, or simultaneously with compression.

The die members are preferably pivotably connected at a plurality of pivot joints and the die member moving means and pivot joints are operative to move the die members along the respective plane upon pivoting the pivot joints. Preferably, both die means comprise relatively movable die members operative to be moved in the respective plane in opposed directions.

These and other aspects of the present invention will be more apparent from the following description of the preferred embodiments thereof when considered with the accompanying drawings.

BRIEF DESCRIPTION OF THE DRAWINGS

The present invention is illustrated by way of example and not limitation in the figures of the accompanying drawings in which like numerals refer to like parts and in which.

DESCRIPTION OF THE PREFERRED EMBODIMENTS

The method of the invention will be illustrated by a description of the apparatus according to the invention and the operation thereof.

Figure 1:
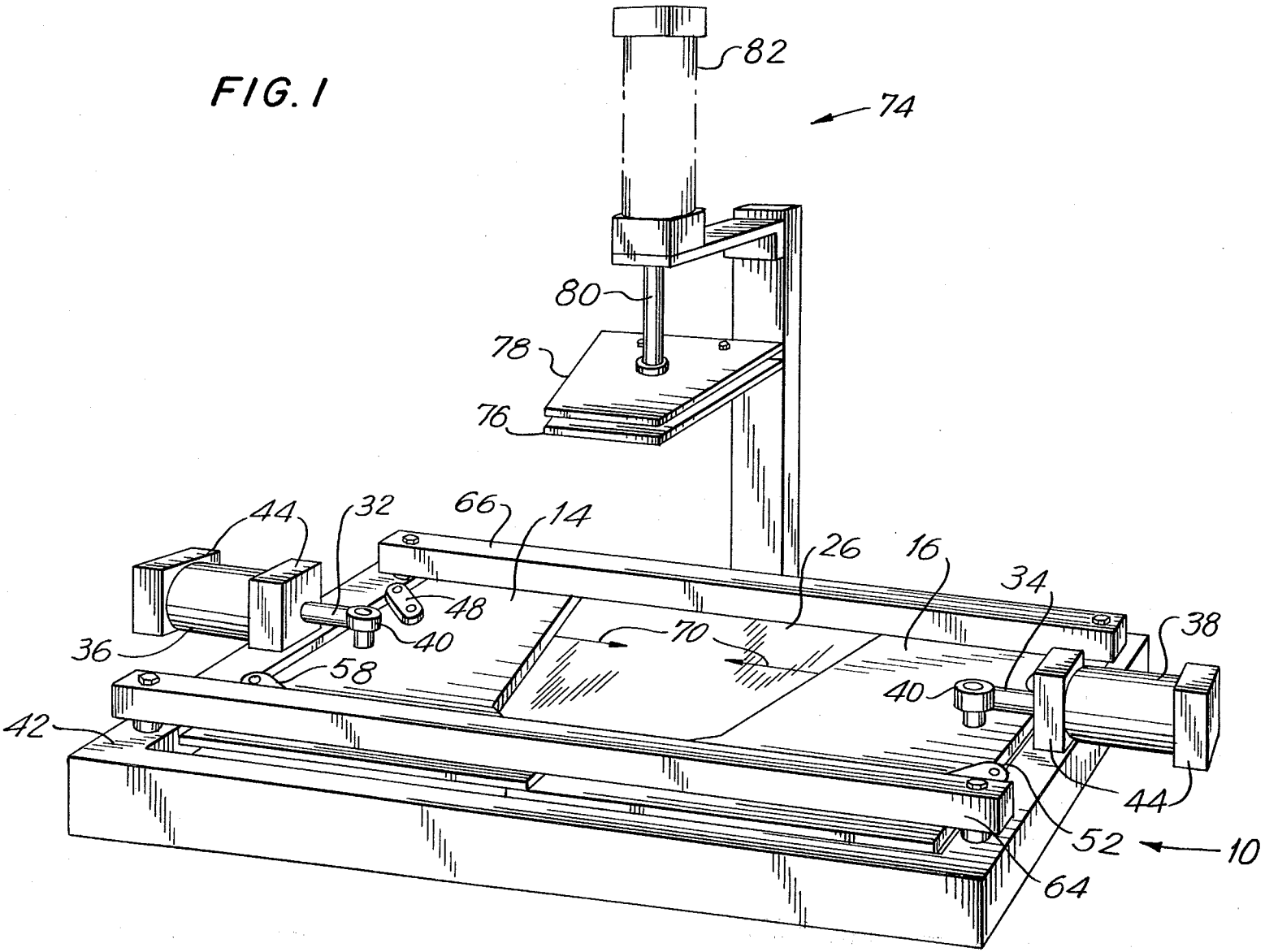
FIG. 1 is a perspective front view of the apparatus according to this invention.
Figure 2:
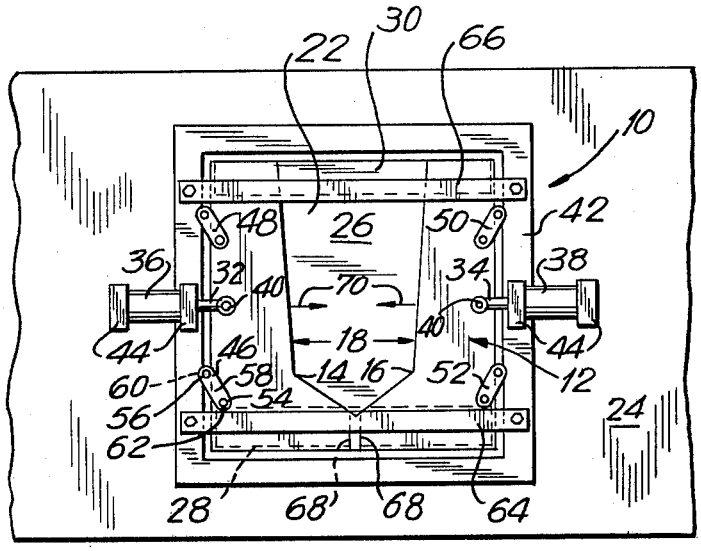
FIG. 2 is a top view of part of the apparatus according to the invention showing the bottom die assembly.

Referring to FIGS. 1 and 2, there is shown a lower die assembly indicated generally as 10 and an upper die assembly indicated generally as 74. The lower die assembly 10 comprises lower die 12 which, in turn, comprises opposed die members 14 and 16. The dies are supported on a movable pressure plate 26, supported by spacer strips 28 and 30. The dies are additionally supported on strips 28 and 30 for slidable movement thereon by moveable plungers 32 and 34 of solenoids 36 and 38. The upper die assembly 74 includes a pair of opposed twin die members 76 and 78 and a plunger 80 of a solenoid 82. The upper die assembly is shown secured to an arm mounted on a stand supporting the bottom die assembly.

Referring to FIG. 2, lower die assembly 10 is shown and includes lower die 12. Lower die 12 comprises opposed die members 14, 16 which are identical except that they are positioned in an opposed, mirror-like relationship. The die members are somewhat L-shaped and are separated by larger space 18 and a smaller space (not shown). The dies are positioned over opening 22 in work surface 24 in which is disposed movable pressure plate 26. The dies are supported on pressure plate 26 by spacer strips 28, 30 whereby a space is provided between the pressure plate and the dies in the area between the strips. The dies are additionally supported on strips 28, 30 for slidable movement thereon by movable plungers 32, 34 of solenoids 36, 38. Fasteners, such as, for example, pins or rods 40 engage the die members and the shafts. The rods may be secured to the plungers by, for example, a threaded arrangement which may include set screws (not shown). A rim molding 42 is positioned about the perimeter of opening 22 and secured to the work surface by fasteners such as, for example, screws (not shown). The solenoids 36, 38 are secured in known manner, for example, to the rim molding 42 and the work surface 24 by adapters 44. The die members 14, 16 are also pivotably secured by pivot joints 46, 48, 50 and 52, each of which (as illustrated by joint 46) comprises a pin or rod 54 secured to the respective die, pin or rod 56 slidably secured in a slot adjacent the rim molding for slidable movement therein and a linking member 58 having sized openings 60, 62 to accept the pins 54, 56, respectively, therein for pivotable movement of the linking member 58. Compression bars 64, 66 are positioned along opposed ends of the die members.

Movement of the lower die members inwardly in opposed directions indicated by arrows 70 into a contracted position (not shown) is accomplished by supplying (not shown) an electric control signal to the solenoids to cause the plungers thereof to extend outwardly therefrom. As a result, pins 56 slide in their respective slots as the linking members 58 pivot about the pins, and the linking members are extended to be parallel (not shown) to the compression bars 64, 66. The lower ends 68 of the die members are overlapping each other (as shown) after the dies are contracted.

Figure 3:
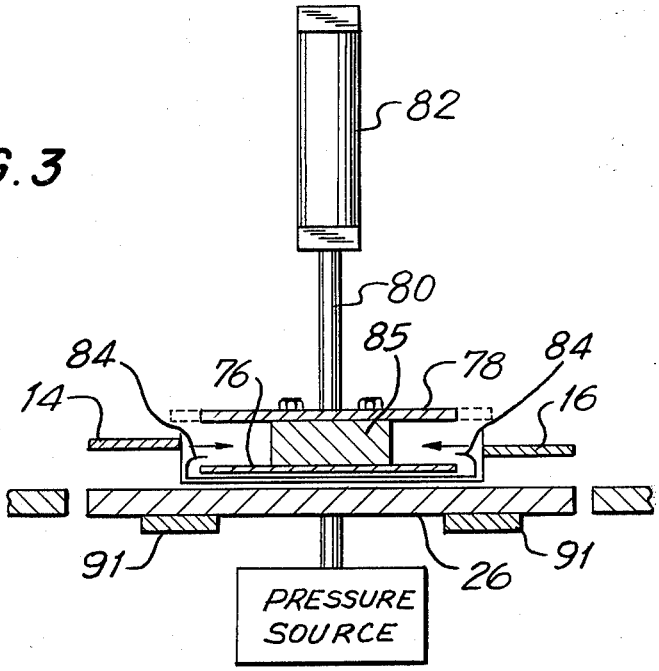
FIG. 3 is a diagrammatic sectional view of part of the apparatus according to the invention showing diagrammatically the top die assembly having been set into operation.

Referring now to FIG. 3, upper die assembly 74 is shown and includes opposed die members 76, 78. The die members are fixedly secured to the plunger 80 of solenoid 82. The die members 76, 78 are shaped so that their perimeter corresponds generally to the shape of space 18 between die members 14, 16 and are spaced 85 apart by a spacer mounted between die members 76, 78.

Movement of the upper die members is accomplished by supplying (not shown) an electrical control signal to the solenoid 82 to cause the plunger thereof to move downwardly relative to the face of the drawing. The die members move so as to assume the position shown in FIG. 3.

The upper die assembly is supported by a bracket (not shown) or other suitable means (e.g., shown as an arm) above the lower die assembly.

Figure 4:
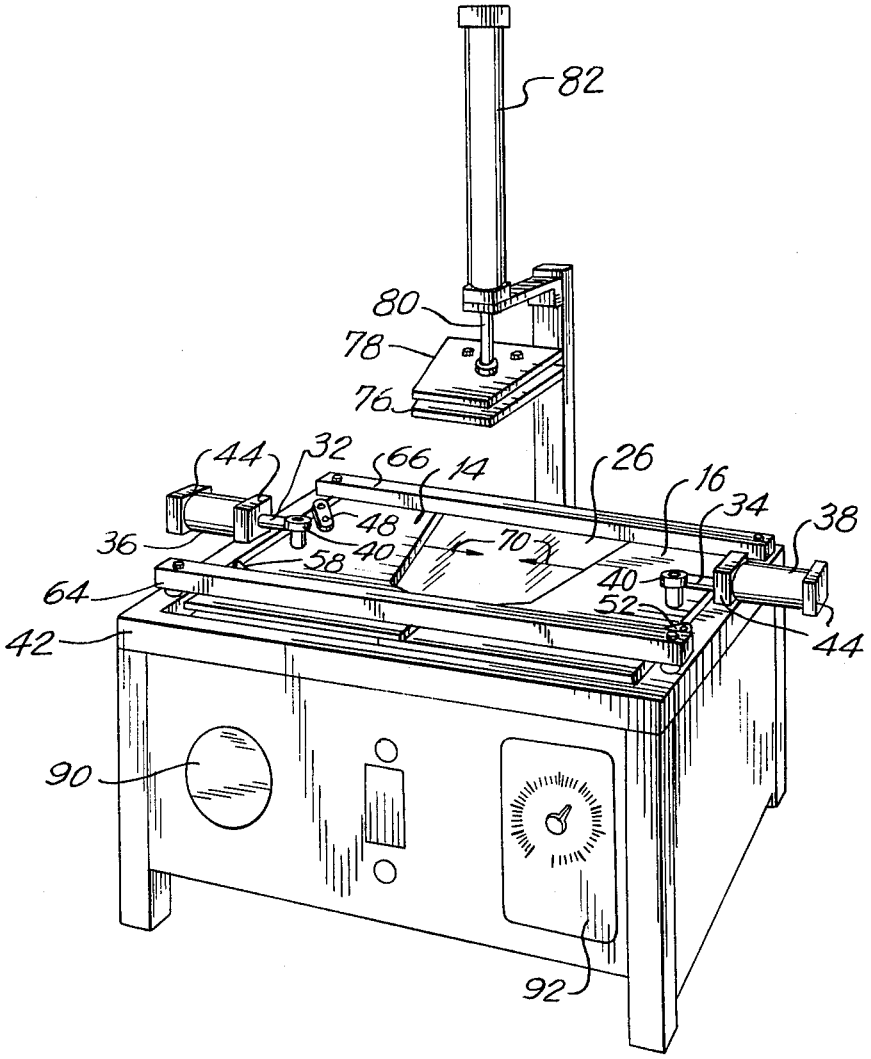
FIG. 4 is a perspective front view of a modified form of the apparatus depicted in FIG. 1, and shows the apparatus of FIG. 1 mounted on a stand, complete with a timing device and a thermostat.

Referring to FIG. 4, which shows a modified form of FIG. 1, there is shown the apparatus of FIG. 1 mounted on a stand, the stand being an optical feature. Also shown in FIG. 4 are a timer and a thermostat, which, if desired, can become part of the present apparatus but not shown in FIG. 1.

With reference now to FIGS. 1–4, operation of the preferred embodiment of this invention will now be described. A work piece in the form of a pocket blank is placed flat over lower die members 14, 16 which are in an expanded position. The thermostat 90 is set to the desired temperature for applying heat to the blank via strip heaters 91 beneath pressure plate 26 and, concurrently therewith, the timer 92 is set for a desired time period of application of such heat. Typically, the source of heat is an electrical one in the form of one or more strip heaters, coils, or cartridges, etc., preferably several strip heaters. In the operation, upper die members 76 and 78, in the form of two separate parallel plates with an intervening spacer 85 therebetween, are lowered so that die member 76 passes through the lower die members 14, 16 (while upper die member 78 remains above them as shown in FIG. 3) to fold the pocket blank; the lower die members are contracted to fold the edges of the pocket blank over the upper die member 76; and the heated pressure plate 26 and upper and lower die assemblies are then moved into compressive engagement (not shown) and the upper and lower die assemblies are thereafter withdrawn and the blank removed. At this time, another pocket blank can be positioned over lower die members 14, 16, and the cycle can be repeated. The pocket blank may now be stitched or otherwise permanently secured to a garment in its creased or folded configuration.

The upper die members 76, 78, preferably twin die plates, when operated in the practice of this invention, as discussed above, provide clear technical advance in the art over the prior art steam-, or heat-, and-pressure devices or, alternatively, the known adhesive-applying apparatus. Such die members, as used, comprise, in combination, a solid pressing means, the lower member of which is adapted to give the fabric blank its desired shape. While not wishing to be bound or limited in any way by scientific theory or principle in this regard, it is nevertheless believed that the dual-membered, upper die assembly of this invention is particularly successful in practice, especially in creasing knitted and woven fabrics designed not to crease, because the blank, immediately after being compressed under conditions of heat and pressure, responds by opening or moving upwardly to a slight extent in the distance separating the two upper die members, and this momentary response enables the resultant configured fabric piece to attain a substantial temperature reduction, perhaps on the order of 100° F. or more. The upper die member, shown in FIG. 3 by the reference numeral 78, prevents the resultant configured fabric piece from fully opening up or moving any farther upward, thereby enabling such piece to cool to the extent noted, and thereby obviating the danger of localized overheating which could damage or destroy the fabric piece (e.g. melting of synthetic fabric) and also the need for a subsequent separate cooling stage. Accordingly, the present upper die assembly successfully accommodates considerable automation of the creasing or folding process with considerably enhanced productivity in production as a consequence.

The upper die members 76, 78 are required to be heat-conductive but capable of being durable under the conditions of heat to which they are exposed, e.g., about 250° F.–about 350° F., preferably about 300° F. with respect to synthetic fabrics such as conventional polyesters; and about 350° F.–about 450° F., preferably about 400° F. for cotton and wool fabrics. Temperatures below the minimum temperatures of these rangers are generally insufficient and render the creasing or folding process inoperative, whereas temperatures above the maximum are generally injurious, or can even be destructive, to the fabric pieces being creased or folded. Of course, as is known in the art, the amount of heat required, i.e., in terms of the temperature or temperature range desired, can be regulated by the duration of time in which such heat is applied or such temperature range is sustained. Thus, the higher the temperature required, the shorter the time needed for creasing, and considerable latitude in operation is thereby afforded the process operator in this regard in view of this relationship.

Preferably, the upper die members of this invention are made of metal, preferably an alloy of steel, such as stainless steel, but other materials may be used, consistent with the requirements of the creasing process or the operator's predilections, such as heat stable plastics, etc.

Preferably, the upper die members are the same or approximately the same size (e.g., "twin dies"), although the upper member can be somewhat larger than the lower one (as shown in FIG. 3) if desired, and preferably they are in the form of flat plates.

The invention has been illustrated by way of example and it is not intended that the invention be so limited as certain changes and modifications may be made thereto without departing from the spirit and scope of the invention. For example, with respect to the fabric piece and the product, fabric pieces other than those specifically disclosed may be configured and they and the invention may be used for products other than garments. For example, fabric pieces may be configured to goods such as luggage, bags and other items for carrying things, as well as to such diverse products as tents, etc. Moreover, the product itself need not be completely comprised of fabric. For example, the fabric pieces configured according to the invention may be adhered to leather and plastic goods. Also, the fabric piece need not be separate from the product as the invention may be practiced by folding hems, or creases and the like on a fabric product itself, as was mentioned hereinbefore. Additionally, with respect to moving the die assemblies and die members, it is intended to cover by the claims pivot joints other than those described in the preferred embodiments and moving means other than solenoids. For example, fasteners such as keys, cotters (screwed or unscrewed, with or without gibs), etc., together with channels or slots approximating, e.g., a 45° angle would comprise obvious equivalents to the present pivot joints. And lineal motors, fluid actuated devices, etc. can be used in lieu of the solenoids.

With respect to the die assemblies and members, it is also intended to cover by the claims die assemblies and members other than those illustrated as preferred embodiments which fall within the spirit and scope of the invention.

The advantages of the present invention, as well as certain changes and modification of the disclosed embodiments thereof, will be readily apparent to those skilled in the art. It is the applicant's intention to cover by his claims all those changes and modifications which could be made to the embodiments of the invention herein chosen for the purposes of the disclosure without departing from the scope of the invention.

What I claim is:

1. In an apparatus for forming and maintaining a fabric piece in a desired configuration comprising (a) forming means for forming the fabric piece into the desired configuration in which parts of the surface of said fabric piece are opposed;

(b) heating means for applying heat to the fabric piece; and (c) pressure means comprising upper pressure means and lower pressure means for bringing together at least said parts of said surface of the formed fabric piece which are opposed under sufficient pressure to cause the desired configuration of the formed fabric piece to be maintained, the improvement comprising said upper pressure means comprising a die assembly comprising upper and lower opposed die members disposed in respective parallel planes operative to be moved from a first position to a second position into contact with the formed fabric piece, and linking means linking said opposed die members in spaced relationship.

2. The apparatus of claim 1, wherein the forming means comprises first and second die means disposed in respective parallel planes operative to be moved from a first spaced apart position through coincidence of respective parallel planes to a second spaced apart position, said first and second die means each comprising a pair of die members disposed in a respective die means plane and opposed at least in part, the die members being operative to be moved along the respective plane, whereby relative movement of the die means through the coincidence thereof is operative to fold at least a part of a fabric piece initially positioned between the first and second die means and movement of the die members along the respective plane being operative to fold the said at least part of the fabric piece on itself, the forming means further comprising means for moving the die members along the respective plane including for moving the die members of one of the die means activator means including a member movable in a first direction and linking means linking said member and said die members for moving said die members in a direction substantially transverse to the first direction, said linking means comprising a plurality of linking members, first pivot means pivotally connecting at least one linking member with each of said die members and second pivot means pivotally connecting said member with each of said at least one linking member.

3. The apparatus of claim 1, wherein said heating means and said pressure means are concurrently operative to apply heat and pressure respectively to the formed fabric piece.

4. The apparatus of claim 1, further comprising a time control means operatively associated with said heat means for controlling the time during which heat is applied to said fabric piece.

5. In an apparatus for forming and temporarily maintaining a fabric piece in a desired configuration during manufacture of the fabric piece comprising (a) forming means for forming the fabric piece into the desired configuration in which parts of the surface of said fabric piece are opposed;

(b) heating means for applying heat to the fabric piece; and (c) pressure means comprising upper pressure means and lower pressure means for bringing together at least said parts of said surface of the formed fabric piece which are opposed under sufficient pressure to cause the desired configuration of the formed fabric piece to be maintained, the improvement comprising said upper pressure means comprising a die assembly comprising upper and lower opposed die members disposed in respective parallel planes operative to be moved from a first position to a second position into contact with the formed fabric piece, and linking means linking the opposed die members in spaced relationship.

6. In a method for forming and maintaining a fabric piece in a desired configuration during manufacture, comprising the steps of forming the fabric piece into the desired configuration in which parts of said surface are opposed, heating said fabric piece, and bringing together, between upper and lower pressure means, at least said parts of said surface which are opposed under sufficient pressure to cause said parts of said surface to maintain the desired configuration, the improvement comprising said upper pressure means comprising an upper and a lower die member disposed in respective opposed parallel planes limiting the resultant movement, of the heated, compressed product in response to said pressure, in the space between said opposed die members.

7. The method of claim 6 wherein heat is applied during forming of the fabric piece into the desired configuration.

8. The method of claim 6 wherein heat and pressure are concurrently applied to the formed fabric piece.

9. The method of claim 6, wherein the fabric piece and the fabric product comprise a single fabric piece.

10. The method of claim 6, wherein the fabric piece is separate from the fabric product.

11. The method of claim 6, wherein the fabric piece comprises a fabric pocket blank and the fabric product comprises a garment.

12. The method of claim 6, wherein the fabric piece is chosen from the group consisting of pocket blanks, facings, cuffs, and yokes.

* * * * *